US008321983B2

(12) United States Patent
Civanelli et al.

(10) Patent No.: US 8,321,983 B2
(45) Date of Patent: Dec. 4, 2012

(54) METHOD FOR CONTROLLING A CYCLE OF OPERATION IN A LAUNDRY TREATING APPLIANCE

(75) Inventors: Claudio Civanelli, Travedona Monate (IT); Layne E. Heilman, Osceola, IN (US); Sarah Ihne, Waiblingen (DE)

(73) Assignee: Whirlpool Corporation, Benton Harbor, MI (US)

( * ) Notice: Subject to any disclaimer, the term of this patent is extended or adjusted under 35 U.S.C. 154(b) by 78 days.

(21) Appl. No.: 12/898,151

(22) Filed: Oct. 5, 2010

(65) Prior Publication Data

US 2012/0079664 A1 Apr. 5, 2012

(51) Int. Cl.
*D06F 33/00* (2006.01)

(52) U.S. Cl. ..... 8/159

(58) Field of Classification Search ..... 8/158, 159; 68/12.02, 12.12, 12.22
See application file for complete search history.

(56) References Cited

U.S. PATENT DOCUMENTS

| | | | | |
|---|---|---|---|---|
| 5,129,241 | A * | 7/1992 | Kiuchi et al. | 68/12.04 |
| 5,263,215 | A * | 11/1993 | Moon | 8/158 |
| 5,527,487 | A * | 6/1996 | Mikkelsen et al. | 510/393 |
| 6,544,943 | B1 * | 4/2003 | Ricci et al. | 510/446 |
| 7,045,021 | B2 * | 5/2006 | Ewing et al. | 134/29 |
| 7,114,209 | B2 | 10/2006 | Metzger-Groom et al. | |
| 7,473,551 | B2 | 1/2009 | Warthoe | |
| 7,650,766 | B2 | 1/2010 | Shaffer | |
| 2001/0049846 | A1 * | 12/2001 | Guzzi et al. | 8/158 |
| 2002/0177232 | A1 | 11/2002 | Melker et al. | |
| 2003/0191043 | A1 * | 10/2003 | Becker et al. | 510/392 |
| 2003/0196278 | A1 | 10/2003 | Durfee | |
| 2003/0213503 | A1 * | 11/2003 | Price et al. | 134/18 |
| 2006/0042658 | A1 | 3/2006 | Engler | |
| 2007/0292958 | A1 * | 12/2007 | Lacourse et al. | 436/34 |
| 2008/0244836 | A1 | 10/2008 | Kim et al. | |
| 2009/0282902 | A1 | 11/2009 | Warthoe | |
| 2011/0174340 | A1 * | 7/2011 | Choczaj et al. | 134/26 |

FOREIGN PATENT DOCUMENTS

| | | | |
|---|---|---|---|
| EP | 2113599 | A1 | 11/2009 |
| GB | 2266898 | A | 11/1993 |
| JP | 06-142391 | * | 5/1994 |
| WO | 2008/047095 | A1 | 4/2008 |
| WO | WO 2008/096350 | * | 8/2008 |

* cited by examiner

*Primary Examiner* — Frankie L Stinson
(74) *Attorney, Agent, or Firm* — Clifton G. Green; McGarry Bair PC

(57) ABSTRACT

A method for controlling a laundry treating appliance having a treating chamber for treating laundry may provide a wash liquid including an enzyme into the treating chamber to effect an enzymatic reaction having at least one constituent product, monitor the concentration of the at least one constituent product, and alter the control of the laundry treating appliance in response to the concentration reaching a plateau.

30 Claims, 7 Drawing Sheets

METHOD FOR CONTROLLING A CYCLE OF OPERATION IN A LAUNDRY TREATING APPLIANCE

BACKGROUND OF THE INVENTION

A laundry treating appliance, such as a washing machine, typically has a configuration in which a load of laundry is placed in a treating chamber for treatment with a treating chemistry according to a cycle of operation. In the case of a washing machine, during a wash cycle of operation, laundry may be treated with a treating chemistry comprising a detergent composition for washing the laundry by removing soil and stains from the laundry. The washing of the laundry by the detergent composition may be supplemented by the use of enzymes to facilitate the breakdown and removal of soil and stains from the laundry during a cycle of operation.

BRIEF DESCRIPTION OF THE INVENTION

A method of controlling a laundry treating appliance comprising providing a wash liquid including an enzyme into a treating chamber to effect an enzymatic reaction having at least one constituent product, monitoring the concentration of the at least one constituent product, and altering the control of the laundry treating appliance in response to the concentration reaching a plateau.

DESCRIPTION OF AN EMBODIMENT OF THE INVENTION

Figure 1:
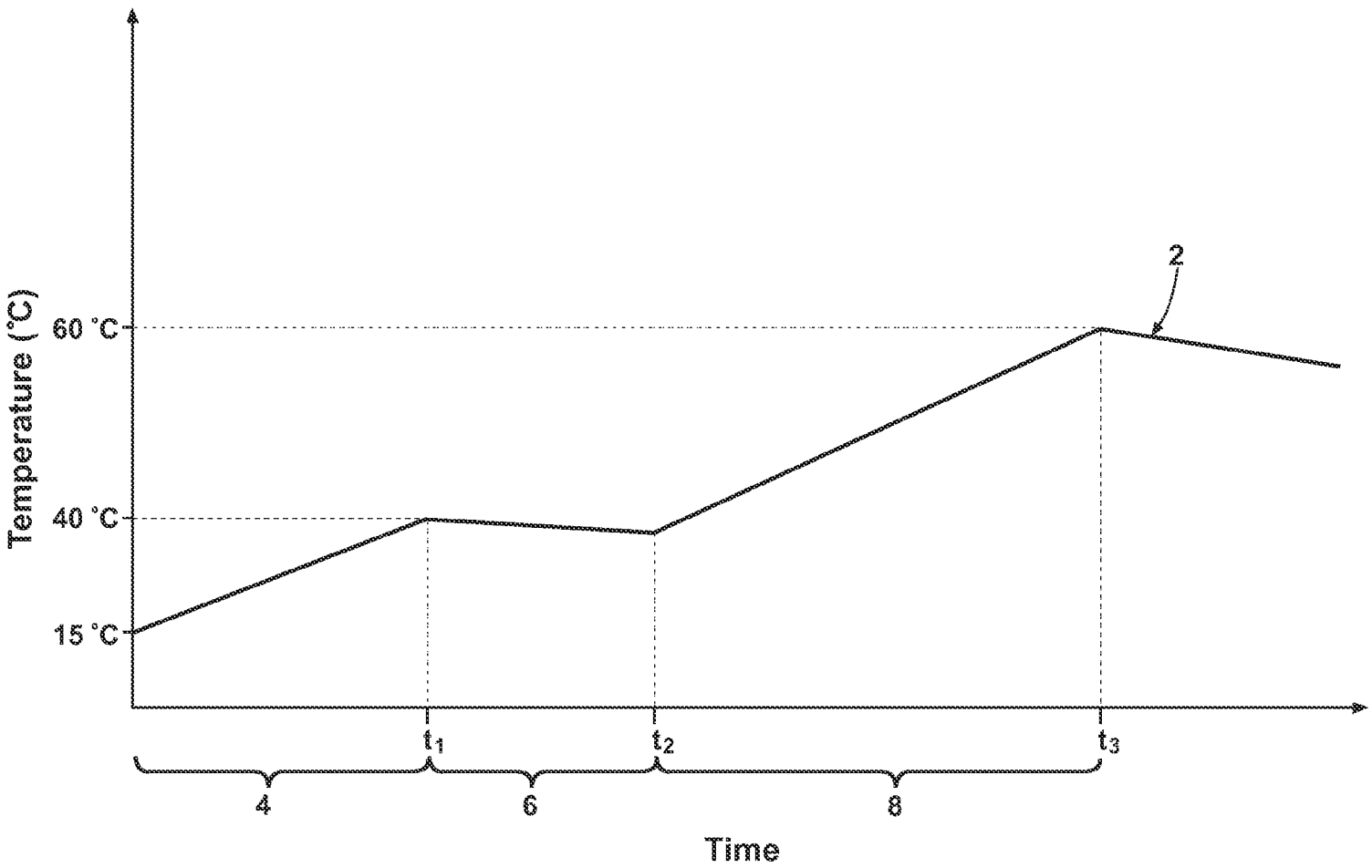
FIG. 1 is a plot of temperature with respect to time for a wash cycle illustrating an exemplary temperature profile of a wash cycle during which the invention may be applied; phenomena the invention is addressing.

FIG. 1 illustrates an exemplary temperature profile 2 with respect to time for a wash cycle, in a washing machine, during which the invention may be applied. The temperature profile 2 may be of a wash cycle used for treating laundry using one or more enzymes. The illustrated temperature is of the liquid in the washing machine, although other references may be used, such as the temperature of the laundry.

During the wash cycle, enzymes may be provided with other treatment aids such as a detergent or may be provided separately from other treatment aids. Such treating aids, especially enzymes, having temperature ranges in which they are most active and react with the soils on the laundry. If the temperature is below the range, the enzymes are essentially practically inactive. Above the temperature range, the enzymes may be rendered inactive or may be destroyed for practical purposes. The temperature profile may be selected to take advantage of the anticipated treating chemistries to make sure a time period is provided during which the treating chemistry is most active for better cleaning performance.

The temperature profile is illustrated as having a first heating phase 4, an enzymatic reaction phase 6, and a second heating phase 8. The first heating phase 4 may include heating the wash liquid until the temperature of the wash liquid reaches 40 degrees Celsius at a first time $t_1$, with the 40 degrees Celsius temperature representing a temperature within the range of the anticipated enzyme. During the enzymatic reaction phase 6, the heating of the wash liquid may be stopped and/or controlled such that the temperature of the wash liquid is within the temperature range of the enzyme, which is illustrated as generally at or around 40 degrees Celsius for a predetermined period of time, such as 5 minutes, for example. As illustrated, the heating of the liquid is stopped for the time period $t_2$, which is indicated by the slope in the profile falling slightly between $t_1$ and $t_2$.

After a predetermined period of time ending at time $t_2$, the enzymatic reaction phase 6 ends and the second heating phase 8 begins, which ends at a second time $t_3$. During the second heating phase 8, the wash liquid may be heated to a second temperature, such as 60 degrees Celsius. The second temperature may be determined as functions of the wash cycle and other factors, such as the presence of other treatment aids. For example, many bleaching agents exhibit increased efficacy at temperatures around 60 degrees Celsius.

Figure 2:
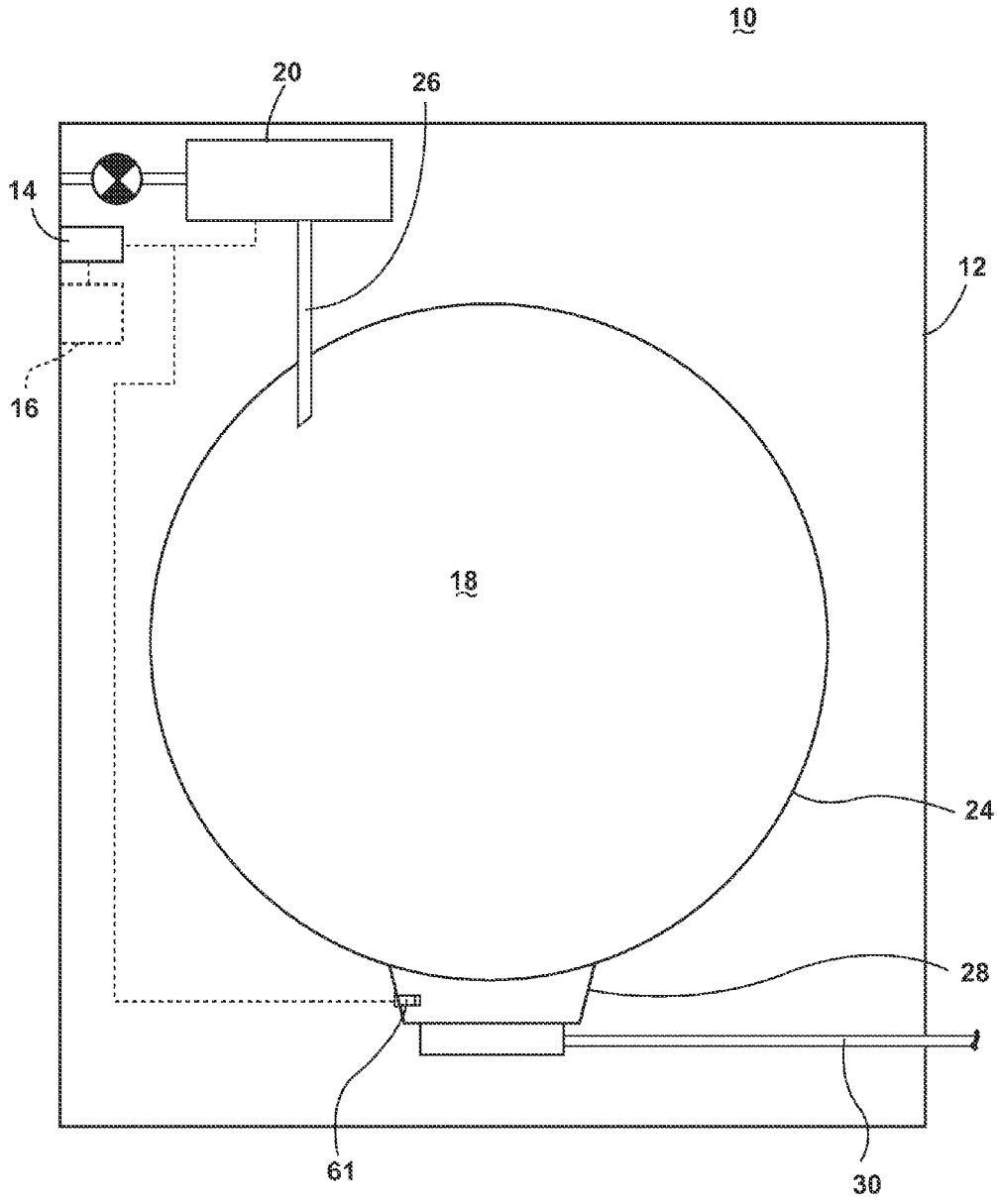
FIG. 2 is a schematic view of a treating appliance according to a first embodiment of the invention.

FIG. 2 is a schematic view of a treating appliance according to a first embodiment of the invention. The treating appliance 10 according to an embodiment of the invention may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; a revitalizing machine and a dishwasher.

The treating appliance 10 may include a cabinet 12 having a controller 14 for controlling the operation of the treating appliance 10 to complete a cycle of operation. The controller 14 may be operably coupled with a user interface 16 to receive user selected inputs and communicate information with the user. The treating appliance 10 may further include a treating chamber 18 located within the cabinet 12 for receiving laundry to be treated during a cycle of operation, a dispenser 20 for dispensing a treating chemistry according to a cycle of operation, and a sensor 61.

The treating chamber 18 may be fluidly coupled with the dispenser 20 through a dispensing conduit 26 such that the dispenser 20 may dispense at least one treating chemistry stored within the dispenser 20 according to a cycle of operation into the treating chamber 18. The treating chamber 18 may be fluidly coupled with a drain or sump 28 that may collect liquid received with the treating chamber 18 and/or drain the liquid to a drain conduit 30. The liquid collected and/or drained by the sump 28 may include water and/or one or more treating chemistries that may be added to the treating chamber 18 during a cycle of operation. The liquid may be recirculated within the treating chamber 18, kept in the sump 28 for use as an immersion or partial immersion wash, and/or drained. Non-limiting examples of treating chemistries include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

As illustrated, the sensor 61 may be fluidly coupled with the sump 28. Alternatively, the sensor 61 may be fluidly coupled with the treating chamber 18 or drain conduit 30 to detect a characteristic of the wash liquid that may be received by or formed in the treating chamber 18, sump 28 or drain conduit 30. One or more sensors 61 may be operably coupled to the controller 14 to communicate with the controller 14. Non-limiting examples of sensors 61 that may be communicably coupled with the controller 14 include: a conductivity sensor, a turbidity sensor, a SAW (surface acoustic wave) sensor, an optical sensor, such as a UV-Vis or Infrared sensor, a conductivity sensor, a liquid level sensor, and a chemical sensor. While it is convenient to locate the sensor in the sump, the sensor 61 may be located at any location that is suitable for it to sense the desired characteristic.

The sensor 61 may be used to determine a characteristic of the wash liquid, such as information indicative of an amount of one or more chemical constituents in the wash liquid and communicate the determined characteristic with the controller 14 during a cycle of operation.

Figure 3:
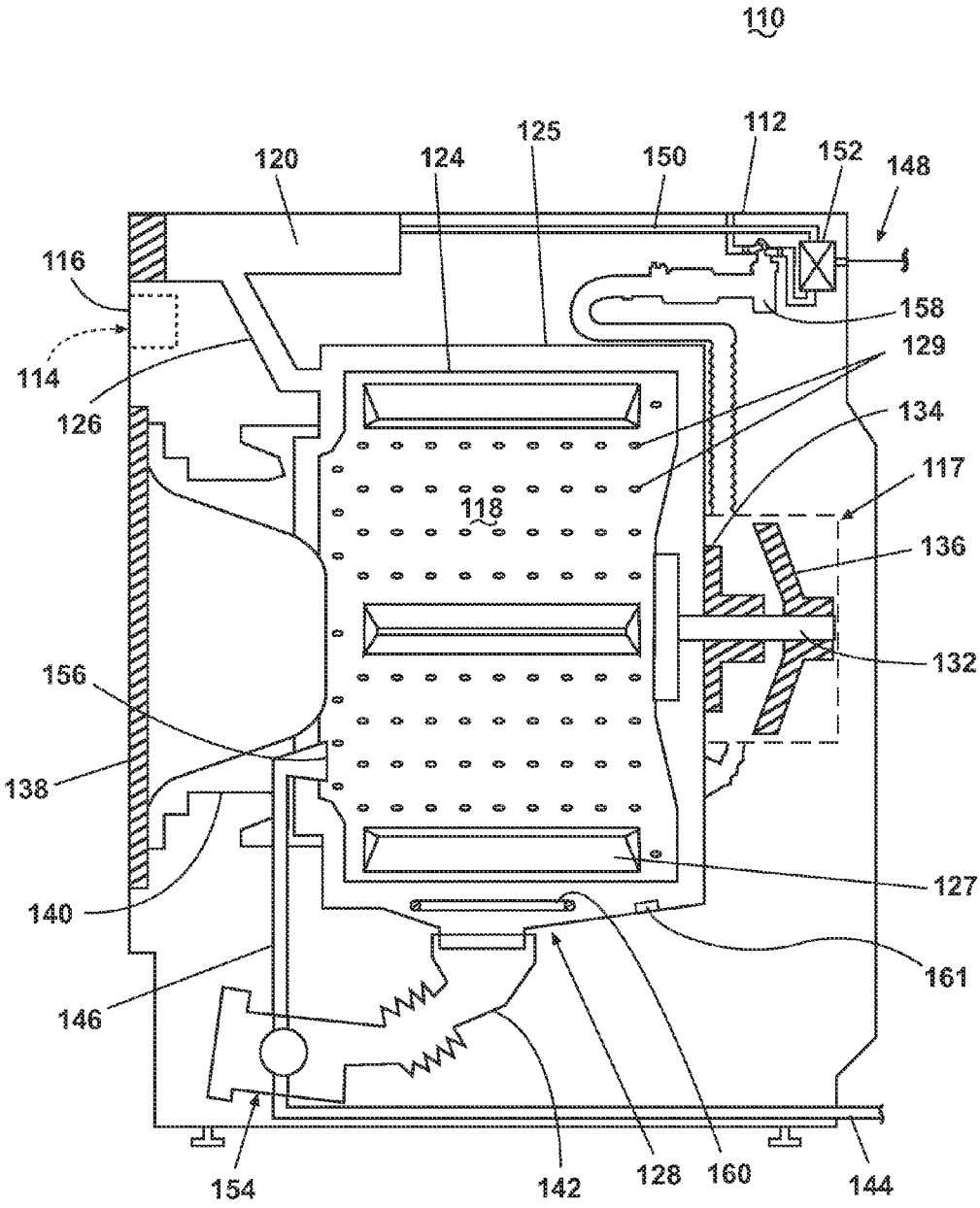
FIG. 3 is a schematic view of a laundry treating appliance in the form of a washing machine according to a second embodiment of the invention.

FIG. 3 is a schematic view of a laundry treating appliance according to a second embodiment of the invention in the form of a washing machine 110 which is similar in structure to the treating appliance 10. Therefore, elements in the washing machine 110 similar to the treating appliance 10 will be numbered with the prefix 100. The washing machine 110 described herein shares many features of a traditional automatic washing machine, which will not be described in detail except as necessary for a complete understanding of the invention.

FIG. 3 provides a schematic view of the washing machine 110 that may include a cabinet 112 defining an interior. A treating chamber 118 of the washing machine 110 may be defined by a drum 124 located within the cabinet 112 for receiving laundry to be treated during a cycle of operation. The drum 124 may be mounted within a tub 125 and may include a plurality of perforations 129 such that liquid may flow between the tub 125 and the drum 124 through the perforations 129.

A plurality of baffles 127 may be disposed on an inner surface of the drum 124 to lift the laundry load received in the treating chamber 118 while the drum 124 rotates. A motor 117 may be directly coupled with the drive shaft 132 to rotate the drum 124. The motor 117 may be a brushless permanent magnet (BPM) motor having a stator 134 and a rotor 136. Alternately, the motor 117 may be coupled to the drum 124 through a belt and a drive shaft to rotate the drum 124, as is known in the art. Other motors, such as an induction motor or a permanent split capacitor (PSC) motor, may also be used. The motor 117 may rotate the drum 124 at various speeds in either rotational direction.

A door 138 may be movably mounted to the cabinet 12 to selectively close both the tub 125 and the drum 124 may be selectively closed by a door 138. A bellows 140 may couple an open face of the tub 125 with the cabinet 112, and the door 138 seals against the bellows 140 when the door 138 closes the tub 125.

A controller 114 for controlling the operation of the washing machine 110 to complete a cycle of operation may be provided on the cabinet 12. A user interface 116 that may include one or more knobs, switches, displays, and the like for communicating with the user, such as to receive input and provide output.

While the illustrated washing machine 110 includes both the tub 125 and the drum 124, with the drum 124 defining the laundry treating chamber 118, it is within the scope of the invention for the washing machine 110 to include only one receptacle, with the receptacle defining the laundry treating chamber for receiving the laundry load to be treated.

The washing machine 110 of FIG. 3 may further include a liquid supply and recirculation system for supplying liquid, such as water, that may be used alone or mixed with a treating chemistry, which may then be applied to the laundry in the treating chamber 118. The liquid supply and treating system may include a water supply 148, such as a household water supply, which may be coupled to a supply conduit 150 by an inlet valve 152 for controlling the flow of liquid from the water supply 148.

A dispenser 120 may be fluidly coupled to the supply conduit 150 and to the treating chamber 118 by a dispensing conduit 126 to provide a liquid path from the water supply 148, through the dispenser 120, and to the treating chamber. In this way, treating chemistry in the dispenser 120 may be added to the water from the water supply 140 to form a treating chemistry that is supplied to the treating chamber 118.

The dispensing conduit 126 may fluidly couple the dispenser 120 with the tub 125. The dispensing conduit 126 may couple with the tub 125 at any suitable location on the tub 125 and is shown as being coupled to a front wall of the tub 125 in FIG. 3 for exemplary purposes. The liquid that flows from the dispenser 120 through the dispensing conduit 126 to the tub 125 typically enters a space between the tub 125 and the drum 124 and may flow by gravity to a sump 128 formed in part by a lower portion of the tub 125. The sump 128 may also be formed by a sump conduit 142 that may fluidly couple the lower portion of the tub 125 to a pump 154. The pump 154 may direct liquid to a drain conduit 144, which may drain the liquid from the washing machine 110, or to a recirculation conduit 146, which may terminate at a recirculation inlet 156. The recirculation inlet 156 may direct the liquid from the recirculation conduit 146 into the drum 124. The recirculation inlet 156 may introduce the liquid into the drum 124 in any suitable manner, such as by spraying, dripping, or providing a steady flow of the liquid.

The liquid supply and recirculation system may further include one or more devices for heating the liquid such as a steam generator 158 and/or a sump heater 160. The steam generator 158 may be provided to supply steam to the treating chamber 118, either directly into the drum 124 or indirectly through the tub 125 as illustrated. The valve 152 may also be used to control the supply of water to the steam generator 158. The steam generator 158 is illustrated as a flow through steam generator, but may be other types, including a tank type steam generator. Alternatively, the sump heater 160 may be used to generate steam in place of or in addition to the steam generator 158. Further, the sump heater 160 may be used to heat the laundry or wash liquid as part of a cycle of operation. The steam generator 158 may be controlled by the controller 114 and may be used to heat the laundry and or wash liquid as part of a cycle of operation, much in the same manner as sump heater 160. The steam generator 158 may also be used to introduce steam to treat the laundry as compared to merely heating the laundry.

Additionally, the liquid supply and recirculation system may differ from the configuration shown in FIG. 3, such as by inclusion of other valves, conduits, wash aid dispensers, sensors, such as water level sensors and temperature sensors, and the like, to control the flow of liquid through the washing machine 110 and for the introduction of more than one type of detergent/wash aid. Further, the liquid supply and recirculation system need not include the recirculation portion of the system or may include other types of recirculation systems.

As illustrated, at least one sensor 161 may be fluidly coupled with the sump 128 to determine a characteristic of the wash liquid that may be received by or formed within the treating chamber 118 to treat laundry. Alternatively, one or more sensors 161 may be fluidly coupled with other components of the washing machine 110 such as the drum 124, sump conduit 142, drain conduit 144, or recirculation conduit 146. As with the sensor 61, the sensor 161 may be located anywhere in the washing machine 110 such that it is capable of determining a characteristic of the wash liquid, such as information indicative of an amount of one or more chemical constituents in the wash liquid and communicate the determined characteristic with the controller 114 during a cycle of operation. The sensor 161 may be of any type, including those describe for sensor 61.

Figure 4:
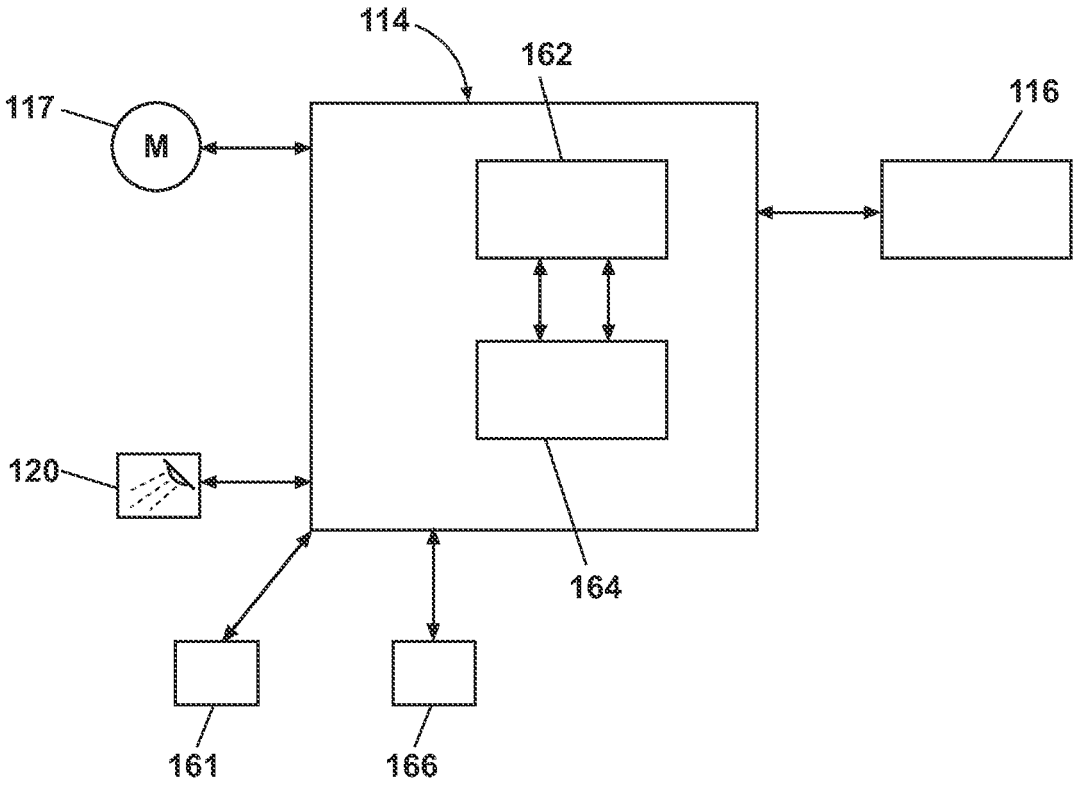
FIG. 4 is a schematic view of a control system of the laundry treating appliance of FIG. 3 according to a third embodiment of the invention.

As illustrated in FIG. 4, the controller 114 may be provided with a memory 162 and a central processing unit (CPU) 164. The memory 162 may be used for storing the control software that is executed by the CPU 164 in completing a cycle of operation using the washing machine 110 and any additional software. The memory 162 may also be used to store information, such as a database or table, and to store data received from one or more components of the washing machine 110 that may be communicably coupled with the controller 114. The database or table may be used to store the various operating parameters for the one or more cycles of operation, including factory default values for the operating parameters and any adjustments to them by the control system or by user input.

The controller 114 may be operably coupled with one or more components of the washing machine 110 for communicating with and controlling the operation of the component to complete a cycle of operation. For example, the controller 114 may be coupled with the motor 117 for controlling the direction and speed of rotation of the drum 124 or the dispenser 120 for controlling a dose and a frequency of dispensing a treating agent during a cycle of operation. The controller 114 may also be coupled with the user interface 116 for receiving user selected inputs and communicating information to the user.

In addition to the sensor 161, the controller 114 may also receive input from one or more sensors 166, which are known in the art and not shown for simplicity. Non-limiting examples of sensors 166 that may be communicably coupled with the controller 114 include: a treating chamber temperature sensor, a moisture sensor, a weight sensor, a chemical sensor, a position sensor and a motor torque sensor.

The controller 114 may be further operably coupled with the sensor 161 for determining a characteristic of one or more chemical constituents present in the wash liquid such as an amount of a chemical constituent. The chemical constituent present in the wash liquid may be a component of a treating agent that is added to the treating chamber 118 or a product of a reaction between one or more components of a treating agent and one or more other components present in the treating chamber 118, such as soils, proteins, fats, starches and other organic or inorganic materials that may be introduced into the treating chamber 118 by the laundry placed therein.

For example, a treating agent introduced into the treating chamber 118 for treating laundry may include at least one enzyme to treat soils and stains that may be present on the laundry. Enzymes may be used to break down organic constituents in the soils and stains in the laundry, making them more soluble in the wash liquid so that they may be removed and washed away from the laundry. An enzymatic reaction between one or more enzymes that are present in the treating chamber 118, for example in the form of one or more proteases, lipases, amylases and/or other types of enzymes, and the soil and stains present in the laundry may result in products that are more soluble in the wash liquid and that may also be detected by the sensor 161.

For example, the enzymatic reaction between proteins and an enzyme, such as a protease, may produce amino acids which are more soluble in the wash liquid than the proteins. Fatty acids may be produced by the reaction between fats and enzymes such as lipases. Sugars may be produced by the reaction between starches and enzymes such as amylases. The sensor 161 may be configured to determine a characteristic of one or more constituent products of a reaction between one or more enzymes and the soil and stains present in the laundry, such as one or more amino acids, fatty acids or sugars. The exemplary types of enzymes and reactions described herein are not meant to limit the invention in any manner as it will be understood that any suitable enzyme or combination of enzymes may be used to treat the laundry and that the enzymes may react with the soils and stains in the laundry in a known or unknown manner. As used herein, treating the laundry may be used to describe treating soils and stains that are adhered or otherwise coupled with individual items of the laundry and/or soils and stains that may be separated from the individual items of the laundry but present in the wash liquid in which the laundry is immersed and/or in contact with.

The sensor 161 may be configured to determine a characteristic of an amount of one or more constituent products of the enzymatic reaction between one or more enzymes and the soils and stains present in the laundry and communicate the determined characteristic with the controller 114. The controller 114 may receive the information from the sensor 161, determine amount of one or more constituent products of the enzymatic reaction and control the operation of the washing machine 110 as a function of the information received from the sensor 161. Alternatively, the sensor 161 may also include a memory and a central processing unit for storing the sensor information and determining amount of one or more constituent products. The sensor 161 may then communicate the determined amount of the one or more constituent products with the controller 114 and the controller 114 may use the information to control the operation of the washing machine 110.

Determining an amount of the one or more constituent products may include determining at least one of a quantitative and a qualitative amount. A quantitative amount of the constituent product may be determined by determining at least one of the weight or mass, volume, and concentration of the constituent product in the wash liquid. Alternatively, a qualitative amount of the constituent product may be determined by, for example, determining a relative change in an amount of the constituent product. The controller 114 may determine the amount of the constituent product by converting the data received from the sensor 161 into known parameters for measuring an amount, such as weight, volume or concentration, using one or more formulas or data tables stored in the memory 162 of the controller 114. Alternatively, the controller 114 may determine the amount of the constituent product directly from the sensor data, which may be in the form of voltage or current measurements, for example. The amount determined by the sensor 161 may be a function of a single constituent product, for example a specific amino acid or a specific dye, or a function of a type of constituent product, such as fatty acids or constituent products having a predetermined weight or mass.

The previously described laundry treating appliances 10 and 110 may be used to implement one or more embodiments of a method of the invention. Several embodiments of the method will now be described in terms of the operation of the washing machine 110. While the methods are described with respect to the washing machine 110, the methods may also be used with the treating appliance 10 of the first embodiment of the invention. The embodiments of the method of the invention may be used to control the operation of the washing machine 110 to complete a cycle of operation as a function of an amount of at least one constituent product of an enzymatic reaction.

Figure 5:
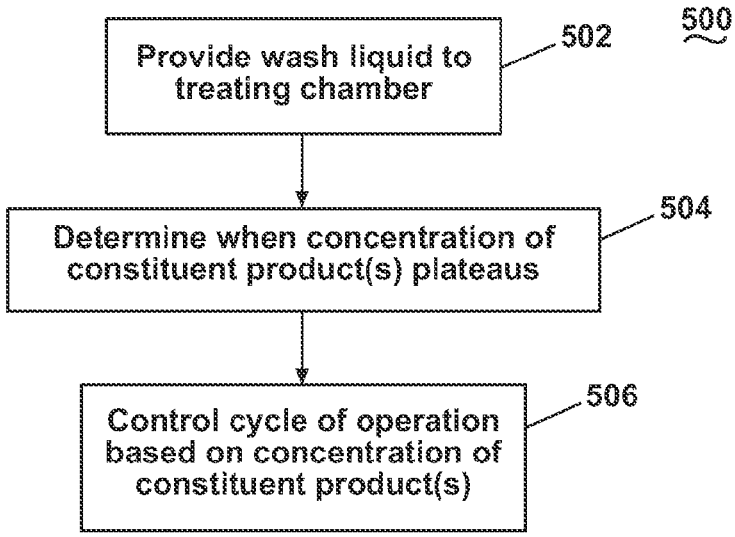
FIG. 5 is a flow chart illustrating a method for controlling a cycle of operation as a function of a concentration of a constituent product according to a fourth embodiment of the invention.

Referring now to FIG. 5, a flow chart of a method 500 for controlling a cycle of operation as a function of a concentration of constituent product within the washing machine 110 according to a fourth embodiment of the invention is illustrated. The sequence of steps depicted for this method and the proceeding methods is for illustrative purposes only, and is not meant to limit any of the methods in any way as it is understood that the steps may proceed in a different logical order or additional or intervening steps may be included without detracting from the invention.

The method 500 starts with assuming that the user has placed one or more laundry articles for treatment within the treating chamber 118 and selected a cycle of operation through the user interface 116. The method 500 may be implemented during any portion of a cycle of operation or may be implemented as a separate cycle of operation. The method 500 may be used to complete a cycle of operation using one or more enzymes either alone or in combination with additional treatment aids, such as detergents and bleaching agents, for example.

At 502 the treating chamber 118 may be provided with wash liquid containing at least one enzyme to treat the laundry according to a cycle of operation. Providing wash liquid may include introducing water and the one or more enzymes separately into the treating chamber 118 to form the wash liquid. Alternatively, water and the one or more enzymes may be mixed in the dispenser 120, then provided to the treating chamber 118 through the dispensing conduit 126. The one or more enzymes may be added alone or in combination with other treatment aids, such as detergents and bleaching agents.

Figure 6:
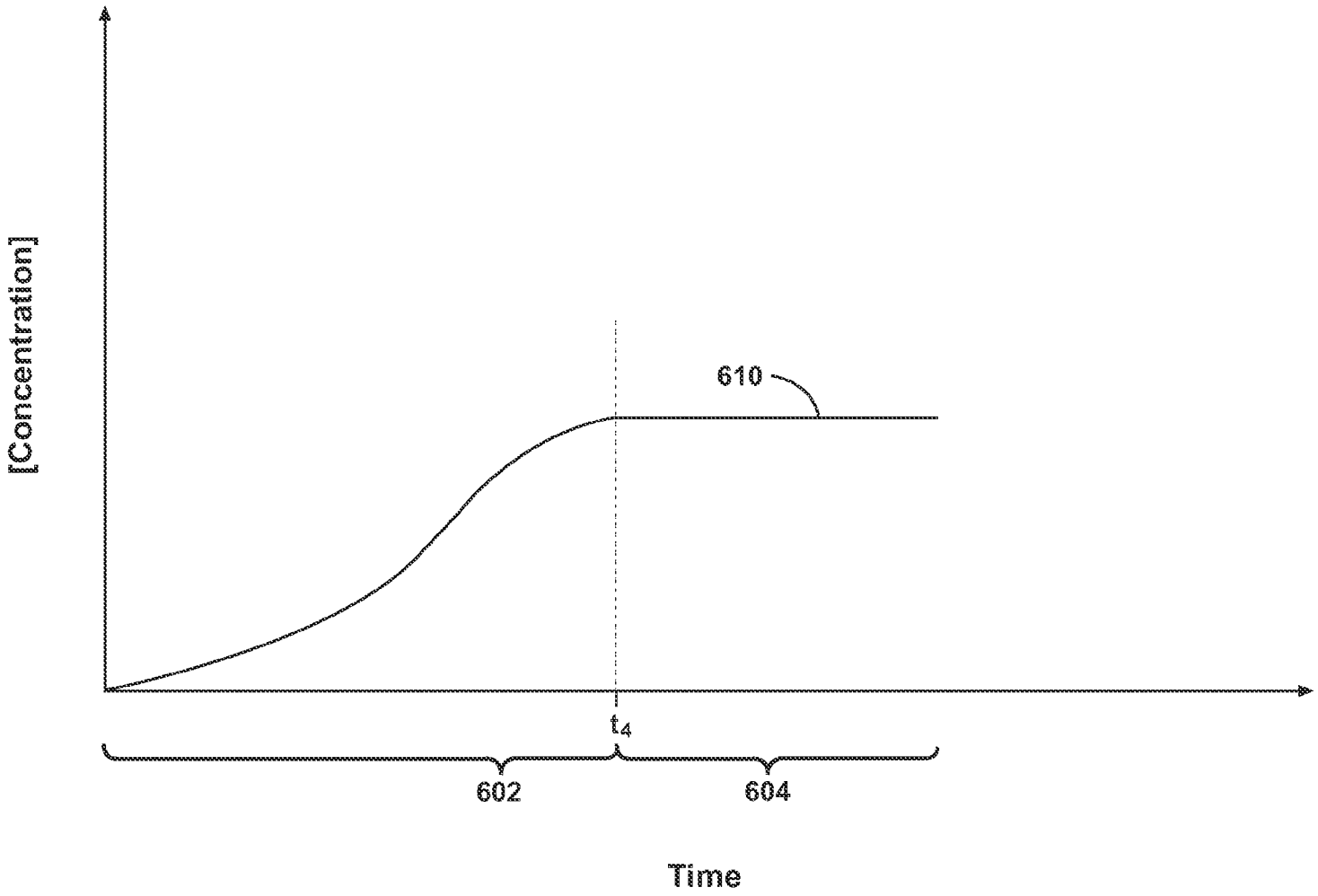
FIG. 6 is a schematic representation of concentration of constituent products of an enzymatic reaction with respect to time according to a fifth embodiment of the invention.

At 504 the sensor 161 may be used to determine when an amount of at least one constituent product of the reaction of the one or more enzymes with the soils and stains in the laundry reaches a plateau, which is illustrated in FIG. 6. As shown in FIG. 6, as the one or more enzymes react with the soils and stains in the laundry, the amount of the constituent products of the enzymatic reaction increases during a reaction phase 602 until the one or more enzymes has generally reacted with all of the soils and stains they are capable of reacting with. At this point, the amount of the constituent products in the wash liquid may level off to form a plateau 610 during a plateau phase 604, which is illustrated as happening at time $t_4$. The enzymes are catalysts, and, as such, they are not consumed during the reaction, but may continue to react with any soils and stains present in the laundry. However, once all of the enzymes are reacting, the level of the constituent products will plateau.

The controller 114 receives the input from the sensor 161 to determine when the amount of constituent products has reached a plateau 610. The plateau 610 can be determined when there is not a substantive change in the constituent products. While there may be some slight variation in the sensed constituent products, it is nominal, and for practical purposes is non existent. These phenomena may be used to detect the plateau. For example, the controller 114 may monitor the amount of the constituent products over time. When the amount of the constituent products detected by the sensor 161 does not change by more than a predetermined amount within a predetermined period of time, the controller 114 may determine that the amount of the constituent products has reached a plateau. In another example, the controller 114 may monitor the slope of the amount of the constituent products and when the slope decreases to a predetermined value, the controller 114 may determine that the amount of the constituent products has reached a plateau. In yet another example, the controller 114 may monitor the change in the amount of the constituent products detected by the sensor 161 and determine the amount of the constituent products has reached a plateau when the change in the amount of constituent products is less than a predetermined amount. In yet another example, the plateau may be determined by the controller 114 when the change in the amount of constituent products reaches a predetermined value. The plateau may be determined based on the amount of a single constituent product or a plurality of constituent products.

Referring back to FIG. 5, at 506, at least a portion of the cycle of operation may be controlled based on the plateau determined at 504. Controlling at least a portion of a cycle of operation may include modifying or changing a portion of the control software that may alter a length of a cycle of operation or a length of a portion of a cycle of operation. Alternatively, the control software may change a cycle of operation to a different cycle of operation. In another example, a portion of a cycle of operation may be switched from one phase to another, for example from a wash phase to a rinse phase or an extraction phase. For example, the determination of a plateau at 504 may be used by the controller 114 to determine that an enzymatic reaction phase in a wash cycle is complete and control the operation of the washing machine 110 to start the next phase in the wash cycle. The control of the cycle of operation by the controller 114 may occur immediately after the determination of the plateau at 504 or at some predetermined time after the determination of the plateau.

The method 500 may be implemented as a cycle of operation or a part of a cycle of operation to treat laundry in the treating chamber 118. For example, the method 500 may be implemented by the controller 114 as a part of a wash cycle or a pre-wash cycle or may be implemented as a stain treating cycle separate from a wash cycle. In another example, the method 500 may be part of a wash cycle that comprises a wash phase, a rinse phase and an extraction phase. The method 500 may be implemented during the wash phase and then a rinse and extraction phase may be implemented, as is known in the art. It is also within the scope of the invention for the method 500 to be implemented during a cycle of operation which includes agitating the laundry within the treating chamber 118 during at least a portion of the cycle of operation. It is also within the scope of the invention for the method 500 to be implemented by the controller 114 once during a cycle of operation or multiple times during a cycle of operation.

Figure 7:
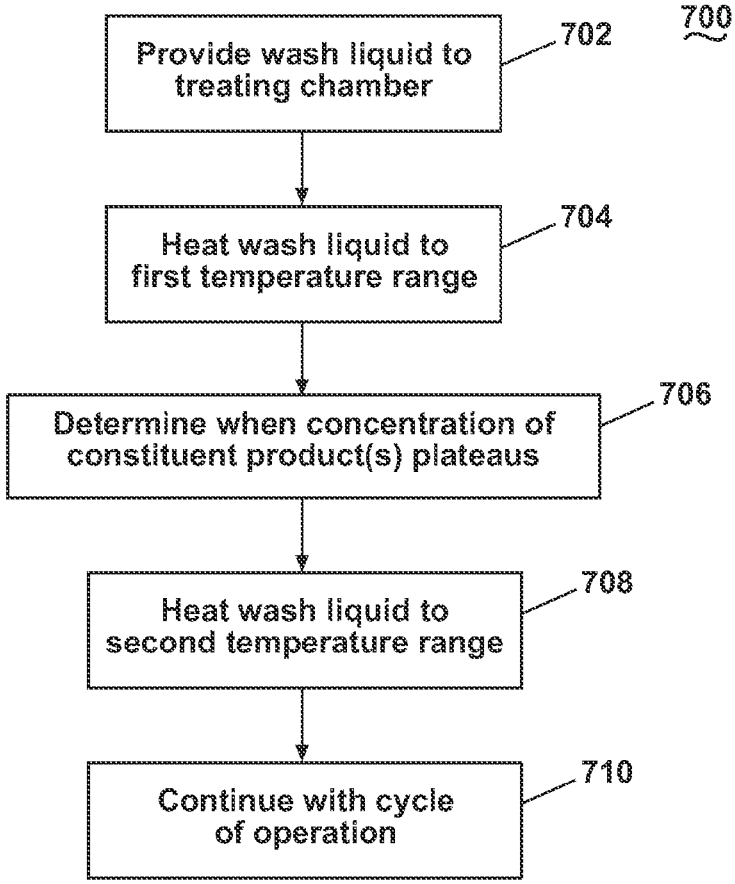
FIG. 7 is a flow chart illustrating a method for controlling a cycle of operation as a function of a concentration of a constituent product according to a sixth embodiment of the invention.

Referring now to FIG. 7, a flow chart of a method 700 for controlling a cycle of operation as a function of a concentration of a constituent product is illustrated according to a sixth embodiment of the invention. The method 700 starts with assuming that the user has placed one or more laundry articles for treatment within the treating chamber 118 and selected a cycle of operation through the user interface 116. Similar to the method 500, the method 700 may be implemented as a separate cycle of operation or may be implemented as part of a cycle of operation, such as part of a wash or pre-wash cycle, for example.

At 702 the treating chamber 118 may be provided with wash liquid containing at least one enzyme to treat the laundry according to a cycle of operation. Providing wash liquid may include introducing water and the one or more enzymes separately into the treating chamber 118 to form the wash liquid. Alternatively, water and the one or more enzymes may be mixed in the dispenser 120, then provided to the treating chamber 118 through the dispensing conduit 126. The one or more enzymes may be added alone or in combination with other treatment aids, such as detergents and bleaching agents.

At 704, the wash liquid may be heated to a first predetermined temperature range. The first predetermined temperature range may be selected such that the wash liquid is heated to a temperature to obtain a desired enzyme activity such that the enzymes may effectively react with the soils and stains in the laundry to achieve a desired outcome for the cycle of operation. If only a single type of enzyme is present in the wash liquid, the first predetermined temperature range may be determined based on the optimal enzyme activity temperature for that enzyme. Alternatively, if multiple different types of enzymes are present which have different optimal enzyme activity temperatures, the first predetermined temperature may be selected to achieve a desired overall enzyme activity.

At 706 the sensor 161 may be used to determine when an amount of at least one constituent product of the reaction of the one or more enzymes with the soils and stains in the laundry reaches a plateau, in a manner similar to that described above at 504 in the method 500 illustrated in FIG. 5.

After the amount of constituent product is determined to reach a plateau at 706, the wash liquid may be heated to a second predetermined temperature range at 708. The second predetermined temperature range may be a temperature range that is higher than the first temperature range at 704. The second predetermined temperature range may be selected as a function of one or more parameters, non-limiting examples of which include the selected cycle of operation, the type of laundry, the degree of soiling and staining of the laundry, and the presence of other treating agents. For example, the second predetermined temperature range may correspond to a temperature at which additional treating agents, such as an oxidizing agent or bleach exhibit a desired level of activity.

As discussed herein, the temperature range may include a single temperature about which the actual temperature of the wash liquid may fluctuate or a range of temperatures, within which the temperature of the wash liquid may fall. For example, the controller 114 may be programmed to control the operation of the heater 160 to maintain the temperature of the wash liquid at a single temperature, such as 40 degrees Celsius, for example. In another example, the controller 114 may be programmed to control the operation of the heater 160 to maintain the temperature of the wash liquid within a predetermined temperature range, such as 40-45 degrees Celsius, for example. It will be understood that physical limitations in the temperature sensor, the heater 160 and the controller 114 may limit the ability of the controller 114 to maintain the wash liquid at the desired temperature or temperature range and thus the temperature of the wash liquid may fluctuate or drift around the desired temperature. However, the controller 114 may be programmed such that the temperature of the wash liquid is generally maintained at the desired temperature.

Alternatively, the controller 114 may be programmed to control the heater 160 to heat the wash liquid to the desired temperature range and then turn the heater 160 off. The temperature of the wash liquid may decrease due to heat dissipation, for example, but may generally be considered to be within range of the desired temperature for the purposes of the embodiment of the invention.

As described above, heating the wash liquid at 704 and 708 may include actively heating and maintaining the temperature of the wash liquid at the desired temperature range by actively controlling the operation of the heater 160 or passively controlling the temperature of the wash liquid by heating the wash liquid to the desired temperature range and then turning the heater 160 off, assuming that the temperature will generally stay within the desired temperature range for at least a period of time according to the invention.

At 710 the controller 114 may determine the end of heating the wash liquid to the second temperature range at 708 and may control the washing machine 110 to complete the cycle of operation. If the method 700 is implemented as part of a phase of a cycle of operation, such as a wash phase or pre-wash phase, the controller 114 may control the washing machine 110 to complete the wash or pre-wash phase and move on to the next phase or phases, such as a rinse and an extraction phase. If the method 700 is implemented as a separate cycle of operation, the controller 114 may then control the washing machine 110 to end the cycle of operation and turn off the washing machine 110 or to move on to the next cycle of operation.

Figure 8:
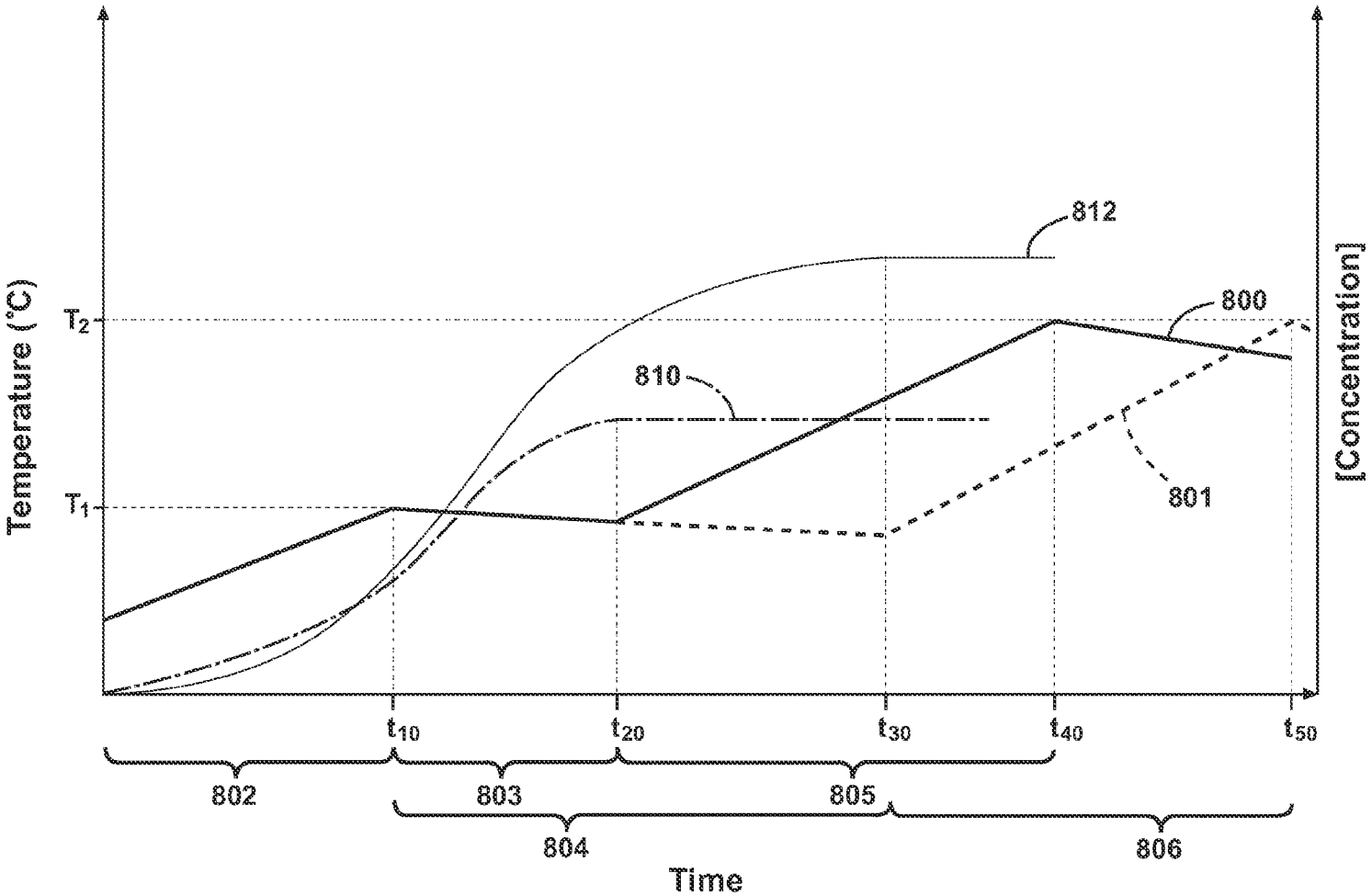
FIG. 8 is a schematic representation of concentration of constituent products of an enzymatic reaction with respect to time according to a seventh embodiment of the invention and over-laid on temperature profile of FIG. 1.

FIG. 8 illustrates an exemplary temperature profile 800 that may be used with either the method 500 illustrated in FIG. 5 or the method 700 illustrated in FIG. 7. For the purposes of discussion, the temperature profile 800 is discussed in the context of the method 700 illustrated in FIG. 7, although it will be understood that the temperature profile 800 may also similarly be used with the method 500. The temperature profile 800 may be used to treat laundry in the treating chamber 118 according to a cycle of operation using one or more enzymes and, optionally, one or more additional treatment aids.

The temperature profile 800 may include a first heating phase 802, an enzymatic reaction phase 803 and a second heating phase 805. Wash liquid may be added at the beginning or during the first heating phase 802 and/or at the beginning of the enzymatic reaction phase 803 to provide the treating chamber 118 with wash liquid including one or more enzymes for treating the laundry.

FIG. 8 also illustrates a plot 810 of the concentration of one or more constituent products of an enzymatic reaction with respect to time during the temperature profile 800 as determined by the sensor 161.

During the first heating phase 802, the controller 114 may control the heater 160 such that the wash liquid within the treating chamber 118 is heated to a first temperature range $T_1$ at a first time $t_{10}$. As illustrated by the plot 810, as the temperature of the wash liquid increases during the first heating phase 802, the concentration of the constituent products determined by the sensor 161 also increases.

As discussed above, as the enzymes in the wash liquid react with the soil and stains in the laundry, the amount of the products of the reaction, for example, amino acids, fatty acids and sugars, in the wash liquid increases. The reactivity of the enzymes in the wash liquid may be dependent on a variety of parameters, non-limiting examples of which include the temperature, pH and ionic strength of the wash liquid and the presence and concentration of other components in the wash liquid. Typically, enzymes used in laundry care are at least temperature dependent, such that the temperature of the wash liquid effects the rate of the enzymatic reaction between the enzymes and the soil and stains in the laundry.

As illustrated in plot 810, even at temperatures below the first temperature range $T_1$, the enzymes in the wash liquid exhibit some activity, as indicated by the increase in concentration of the constituent products determined by the sensor 161. The activity of the enzymes in the wash liquid, and as a result, the concentration of the constituent products of the enzymatic reaction, increases as the temperature of the wash liquid increases to the first temperature range $T_1$. While the wash liquid is at the first temperature $T_1$, the activity of the enzymes and thus the concentration of the constituent products of the enzymatic reaction increases until the enzymes have reacted with all or most of the soil and stains which they are capable of reacting with. At this point, the concentration of the constituent products starts to level off and plateau, as generally indicated at time $t_{20}$.

The sensor 161 may determine the plateau at time $t_{20}$ as described above with respect to 504 of the method 500 and 706 of the method 700 illustrated in FIGS. 5 and 7, respectively. As illustrated by the temperature profile 800, the controller 114 may control the operation of the washing machine 110 such that the enzymatic reaction phase 803 ends and the second heating phase 805 begins when the concentration of the constituent products of the enzyme reaction reaches a plateau. At this time $t_{20}$, the enzymes have generally reacted with all of the soil and stains in the laundry that the enzymes are capable of reacting with and continuing the enzymatic reaction phase 803 lengthens the overall time of the temperature profile without necessarily providing increased benefits to the user.

At the end of the enzymatic reaction phase 803, the controller 114 may control the operation of the washing machine 110 to increase the temperature of the wash liquid in the treating chamber 118 to the second predetermined temperature range $T_2$, which is higher than the first predetermined temperature range $T_1$, at a second time $t_{40}$. The activity of many enzymes which may be used in laundry care may start to decrease in activity and/or degrade at higher temperatures.

In one example, the second predetermined temperature range may be selected according to the temperature at which the activity of an oxidizing agent present in the wash liquid increases to a desired level of activity. For example, many oxidizing agents are most effective around 60 degrees Celsius. Not only may the activity of some enzymes decrease as the temperature of the wash liquid increases, but the oxidizing agents may also inhibit the activity of the enzymes. Therefore, it may be beneficial to wait to increase the temperature of the wash liquid to the second predetermined temperature, which is an effective temperature for the oxidizing agent, until the enzymes have generally reacted with all of the soil and stains present in the laundry. In this manner the temperatures of the temperature profile 800 may be controlled such that the enzymes may effectively react with the soil and stains present in the laundry prior to being inhibited by higher temperatures and/or other components of the wash liquid, such as oxidizing agents.

FIG. 8 also illustrates a temperature profile 801 that may include a first heating phase 802, an enzymatic reaction phase 804 which ends at $t_{30}$ and may be longer than the enzymatic reaction phase 803 described above, and a second heating phase 806, which may end at a second time $t_{50}$. Also illustrated is a plot 812 of the concentration of one or more constituent products of an enzymatic reaction with respect to time during the temperature profile 801 as determined by the sensor 161 for a load of laundry having more soils and stains present in the laundry than that illustrated by plot 810. As illustrated by plot 812, because the laundry has more soils and stains present, the concentration of the constituent products of the reaction of the enzymes with the soil and stains increases until the concentration of the constituent products measured by the sensor 161 reaches a plateau at time $t_{30}$. Accordingly, the length of the enzymatic reaction phase 804 may be increased to time $t_{30}$ to accommodate for the increased amount of the soil and stains present in the laundry. After time reaches $t_{30}$, the controller 114 may control the operation of the washing machine 110 to increase the temperature of the wash liquid in the treating chamber 118 along the temperature profile 801 to the second predetermined temperature range $T_2$. In this manner, the temperature profile 800 may be optimized to obtain a desired cleaning performance as a function of the amount of soil and stains present in the laundry which the enzymes are capable of reacting with.

The invention described herein provides a method for controlling a cycle of operation as a function of a concentration of a constituent product. The method of the invention can advantageously be used compared to the conventional time-based temperature profile in a plurality of ways. For example, enzyme, which is usually an expensive catalyst, can react with laundry in an efficient way such that no portion of the enzyme is destroyed before reacting with and treating laundry. In another example, adaptive temperature profiles can be obtained with respect to the amount of the soils and stains such that laundry with less soils and stains can be treated in a short time while laundry with more soils and stains can be treated in a long time. In yet another example, the invention can provide the user with an improved cleaning outcome.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of controlling a laundry treating appliance comprising a treating chamber for treating laundry, the method comprising:

providing a wash liquid including an enzyme into the treating chamber to effect an enzymatic reaction with any soils in the treating chamber to produce at least one constituent product;

monitoring an amount of the at least one constituent product; and altering the control of the laundry treating appliance in response to the amount of the at least one constituent product reaching a plateau.

2. The method of claim 1 wherein providing a wash liquid comprises introducing the wash liquid into the treating chamber.

3. The method of claim 1 wherein the wash liquid comprises detergent and water.

4. The method of claim 3 wherein the detergent comprises the enzyme and an enzyme inhibitor.

5. The method of claim 4, further comprising heating the wash liquid to a first temperature range where an enzyme activity is greater than an enzyme inhibitor activity.

6. The method of claim 5, further comprising heating the wash liquid to a second temperature range, greater than the first temperature range, where the enzyme inhibitor activity is greater than the enzyme activity.

7. The method of claim 1, further comprising heating the wash liquid to a temperature range corresponding to a desired enzyme activity.

8. The method of claim 7 wherein after the heating of the wash liquid to the temperature range corresponding to a desired enzyme activity, stopping the heating until the plateau is reached.

9. The method of claim 7 wherein the temperature of the wash liquid is maintained within the temperature range corresponding to a desired enzyme activity until the plateau is reached.

10. The method of claim 1, further comprising agitating any laundry within the treating chamber.

11. The method of claim 10 wherein the agitating the laundry comprises rotating the treating chamber.

12. The method of claim 1 wherein the providing a wash liquid and monitoring the amount of the constituent product is part of a wash phase.

13. The method of claim 12, further comprising a rinse phase following the wash phase to rinse at least a portion of the wash liquid from any laundry in the treating chamber with a rinse liquid.

14. The method of claim 13, further comprising an extraction phase following the rinse phase to remove at least a portion of the rinse liquid that may have been absorbed by any laundry in the treating chamber.

15. The method of claim 14 wherein the altering the control of the laundry treating appliance comprises switching from the wash phase to at least one of the rinse phase and the extraction phase.

16. The method of claim 12 wherein the altering the control of the laundry treating appliance comprises at least one of reducing and extending a duration of the wash phase.

17. The method of claim 1 wherein the altering the control of the laundry treating appliance comprises controlling a heating element to heat the wash liquid as a function of the amount of constituent product of the at least one constituent product.

18. The method of claim 1 wherein the monitoring the amount of constituent product comprises sensing a concentration of the at least one constituent product.

19. A method of controlling a laundry treating appliance comprising a treating chamber for treating laundry, the method comprising:

providing a wash liquid including an enzyme and an enzyme inhibitor into the treating chamber;

heating the wash liquid to a first temperature range in which an activity of the enzyme is greater than an activity of the enzyme inhibitor and less than a second temperature range in which the activity of the enzyme inhibitor is greater than the activity of the enzyme to effect an enzymatic reaction with any soils in the treating chamber to produce at least one constituent product;

monitoring an amount of the at least one constituent product; and heating the wash liquid to the second temperature range in response to the amount of constituent product reaching a plateau.

20. The method of claim 19 wherein the providing a wash liquid comprises introducing the wash liquid into the treating chamber.

21. The method of claim 19 wherein the wash liquid comprises detergent and water.

22. The method of claim 21 wherein the detergent includes the enzyme and the enzyme inhibitor.

23. The method of claim 19 wherein after heating the wash liquid to the first temperature range, stopping the heating until the plateau is reached.

24. The method of claim 19 wherein the temperature of the wash liquid is maintained at the first temperature range until the plateau is reached.

25. The method of claim 19, further comprising agitating any laundry within the treating chamber.

26. The method of claim 25 wherein the agitating the laundry comprises rotating the treating chamber.

27. The method of claim 19 wherein the providing a wash liquid and monitoring the amount of constituent product is part of a wash phase.

28. The method of claim 27, further comprising a rinse phase following the wash phase to rinse at least a portion of the wash liquid from any laundry in the treating chamber with a rinse liquid.

29. The method of claim 28, further comprising an extraction phase following the rinse phase to remove at least a portion of the rinse liquid that may have been absorbed by any laundry in the treating chamber.

30. The method of claim 19 wherein the monitoring the amount of the at least one constituent product comprises sensing a concentration of the at least one constituent product.

* * * * *